US005988925A

United States Patent [19]

Baggett

[11] Patent Number: 5,988,925

[45] Date of Patent: Nov. 23, 1999

[54] STACKED PAPER FASTENER

[76] Inventor: R. Sherman Baggett, 3517 Coolheights, Rancho Palos Verdes, Calif. 90275

[21] Appl. No.: 09/181,225

[22] Filed: Oct. 26, 1998

[51] Int. Cl.[6] ..... B42D 1/00; B30B 12/00; B42F 3/00

[52] U.S. Cl. ..... 402/8; 402/60; 402/62; 402/63; 402/64; 402/68

[58] Field of Search ..... 402/60, 8, 62, 402/63, 64, 68

[56] References Cited

U.S. PATENT DOCUMENTS

| | | | |
|---|---|---|---|
| 3,970,331 | 7/1976 | Giulie | 402/63 |
| 5,226,360 | 7/1993 | Kramka | 402/63 |
| 5,257,870 | 11/1993 | Bennett et al. | 402/62 |

*Primary Examiner*—Willmon Fridie, Jr.
*Assistant Examiner*—Mark T. Henderson
*Attorney, Agent, or Firm*—Edgar W. Averill, Jr.

[57] ABSTRACT

A stacked paper fastener having a pair of prongs which may be passed through a pair of holes in a top piece and affixed to the top piece to hold the stacked papers together. The fastener is preferably entirely made of plastic with no sharp edges so that it cannot readily cut a user. Each prong has notches in the outer surface which, when the prongs are passed through a ratchet member, may be pulled tight around the stack of papers. The ratchet member securely holds the stack of papers together until purposely released. The ratchet members have releases which are easily manipulated from above the top piece so that the top piece can be easily removed to add more papers to the stack or to disassemble the stack of papers.

5 Claims, 2 Drawing Sheets

STACKED PAPER FASTENER

BACKGROUND OF THE INVENTION

The field of the invention is office supplies and the invention relates more particularly to fasteners for securing a stack of papers together by passing a pair of prongs through a spaced pair of holes near the top edge or side edge of each sheet of paper. Such fasteners are typically referred to by their trademark of "Acco Fasteners." Such fasteners have a lower piece with a pair of metal prongs which may be oriented vertically. The holes in the paper are then passed through the prongs. Next, the top piece is placed over the prongs and over the stack of paper and the prongs are bent over the top piece and affixed to the top piece to secure the papers in place. A large stack of papers fastened with the above-described prongs which are typically thin metal prongs are notorious for becoming unfastened.

Largely because of the possibility of cuts from the thin metal fasteners, attempts have been made to make fasteners which are fabricated from plastic. One such approach is shown in U.S. Pat. No. 5,096,323 which shows a pair of prongs with a series of holes therethrough which fit through openings in a top piece which have locking tang means which pass through the holes in the prongs. They are then folded over and secured by slide locks. Because the holes must be spaced at discreet distances, the unit also can only be tightened in discreet distances.

U.S. Pat. No. 5,257,870 shows a paper fastener which has a pair of notched prongs which pass under first and second clipping parts. Because it is necessary to feed the prongs through a confined space under the right angular part, the release of the part requires two fingers. Furthermore, once the prongs are under the right angular part, it cannot readily be tightened.

U.S. Pat. No. 5,265,968 shows what appears to be a very expensive two-piece unit which is not easy to manipulate.

There is, thus, a need for a stacked paper fastener which may be easily affixed to a stack of papers and with equal ease released and which may be easily tightened against the stack of papers.

BRIEF SUMMARY OF THE INVENTION

It is an object of the present invention to provide a plastic fastener for a stack of papers which may be easily tightened and remains tight during use and is easily released from the stack of papers.

The present invention is for a stacked paper fastener having a pair of spaced prongs which are passed through a pair of holes and affixed to a top piece. The prong unit has a pair of prongs which have space notches. The notches have an angle side and a catch side. A top piece has a cross-member which has a pair of openings at the ends through which the prongs are passed and a pair of ratchets on the top thereof through which the prongs may be passed. The ratchet members have a pawl which catches the notched sides so that the prongs may be pulled through to tighten the top piece against the stack of papers. The pawls, when engaged, securely fasten the stack of papers. The pawls extend past the ratchet members and may be easily raised by the user to release the prongs and thereby permit the removal of the top piece and the addition or removal of any papers from the stack.

DESCRIPTION OF THE PREFERRED EMBODIMENTS

Figure 1:
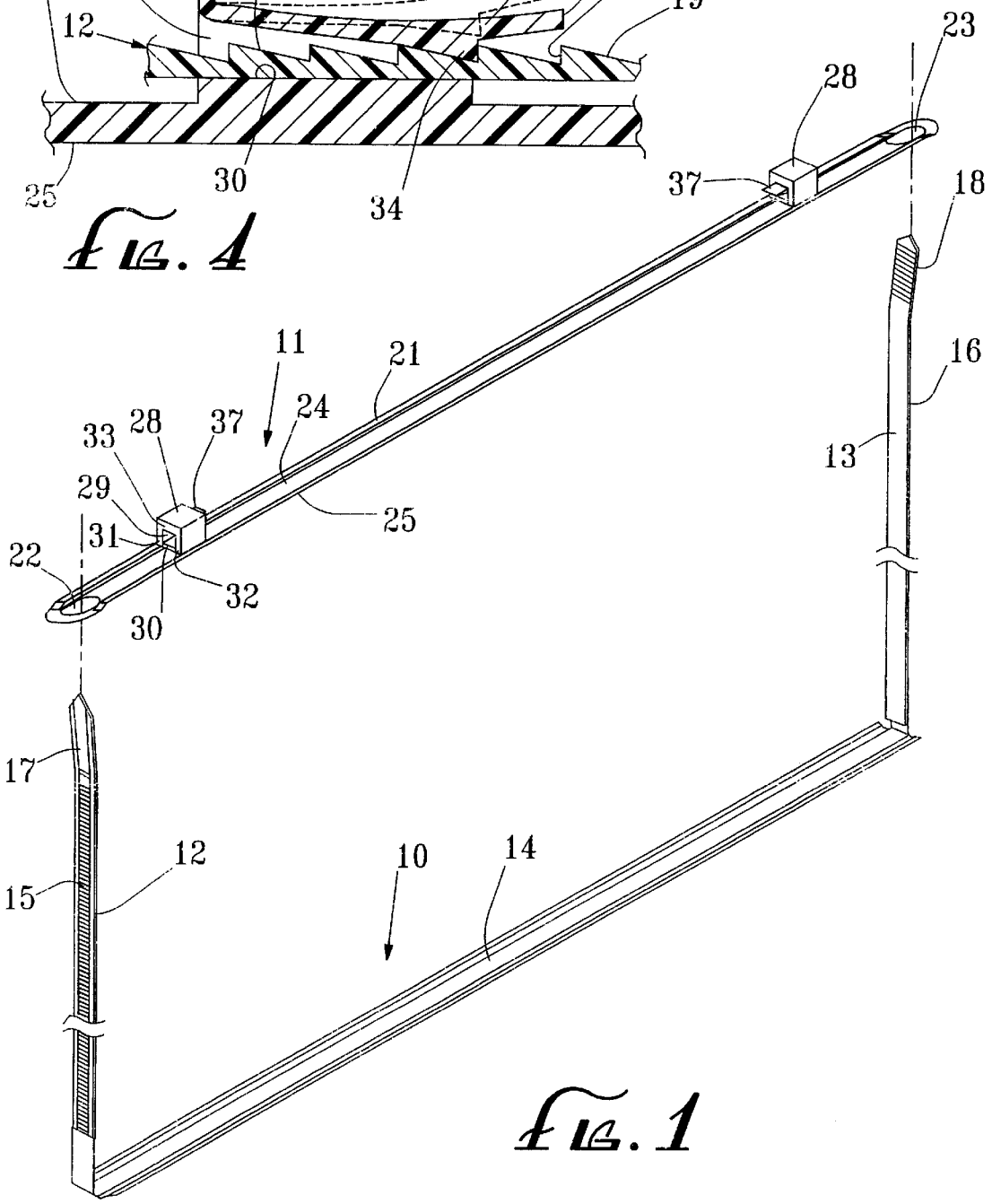
FIG. 1 is an exploded perspective view showing the prong unit and the top piece of the present invention.

The stacked paper fastener is shown in perspective view in FIG. 1, and can be seen to have a prong unit 10 and a top piece 11. Prong unit 10 has first and second vertically oriented prongs 12 and 13 respectively. Each prong is held in a spaced relationship a spaced distance at the ends of a flat elongated base 14. Both of the first and second prongs have a plurality of spaced notches 15 and 16 and an outer face thereof. Each notch as shown in FIG. 4 has an angle side 19 and a catch side 20.

Figures 2, 3:
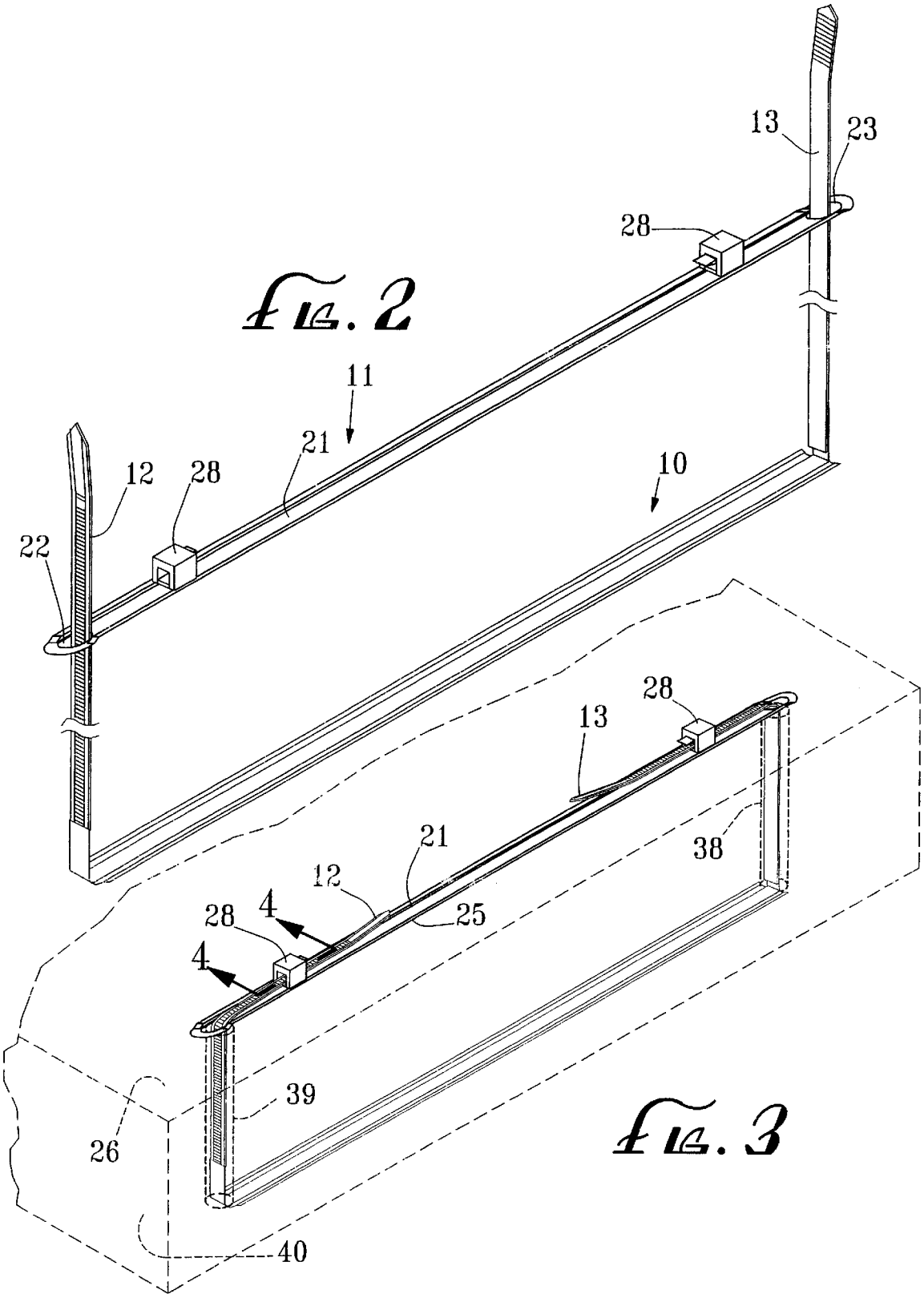
FIG. 2 is a perspective view analogous to FIG. 1 except that the top piece has been passed over the prongs.
FIG. 3 shows the fastener of FIG. 1 fastened over a stack of paper shown in phantom view.

Top piece 11 has a cross-member 21. Cross-member 21 has a pair of openings 22 and 23 spaced to accept prongs 12 and 13 as indicated in FIG. 1. Cross-member 21 has an upper surface 24 and a lower surface 25. As shown in FIG. 3, the lower surface 25 is in contact with the upper surface 26 of a stack of papers shown in phantom view in FIG. 3.

A first ratchet member 28 is formed in the top surface 24 of cross-member 21. Ratchet member 28 is shown in cross-sectional view in FIG. 4. First ratchet member 28 has a passageway 29. The passageway has a bottom 30, sides 31 and 32 and a top 33. This forms a closed ratchet passageway. The closed ratchet passageway has a pawl 34 which rides over the angled sides 19 of notches 15. The pawl catches against the catch sides 20 of notches 15 in a conventional manner which permits the first prong 12 to be pulled through the first ratchet member 28 and to be tightened simply by the pulling of the first prong through the pawl of the ratchet member. The pawl of the ratchet member, when engaged, securely captures the prong until it is deliberately released.

Figure 4:
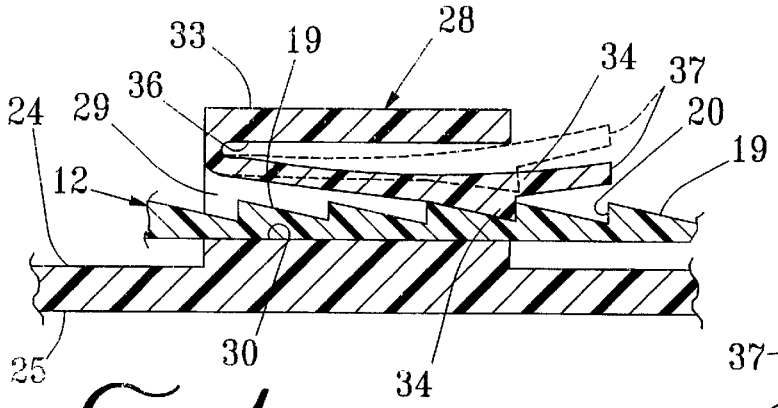
FIG. 4 is a cross-sectional view taken along line 4—4 of FIG. 3.

As also shown in FIG. 4, pawl 34 is held on a flexible arm which is held in a biased manner by being molded in the underside 36 of top 33. A handle 37 extends past the passageway 29 and may be easily lifted as shown in phantom view in FIG. 4 to release the pawl 35 from the catch sides 20 of notches 15, thereby releasing the prong.

In use, the prongs 12 and 13 are passed through holes 38 and 39 in the stack of papers 27. Next, the cross-member 21 is placed over the prongs as indicated in FIG. 2. The prongs 12 and 13 are fed through the passageways of the ratchet members 28 and pulled tight. Because the catch sides 20 of the notches 15 and 16 are closely spaced (25 notches per inch), the adjustment by tightening is very precise. Similarly, the release is very easily done by simply placing one's thumb or forefinger against the end of handle 37 and lifting it against the top 36 of the ratchet member. Needless to say, ratchet members 28 are identical mirror images of one another and the second ratchet member has not been described since it is an identical mirror image of the first ratchet member.

Preferably, the parts are fabricated from nylon which has the ability to be bent while still having a high degree of strength. The base 15 is preferably molded in the shape shown in FIG. 1 so that the prongs are easily oriented in a vertical orientation as also shown in FIG. 1. The fastener may be made available in different lengths, depending upon the anticipated size of the stack of papers to be fastened. The cross-member 21 may be molded from a single piece of plastic as may be the prong unit 10. It is, thus, very economical to fabricate while still having a high degree of ease of use and freedom from possible cutting.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A stacked paper fastener of the type having a pair of spaced prongs which may be passed through a pair of holes and affixed to a top piece comprising:

a prong unit having a first and second vertically oriented prongs held in a spaced relationship at a spaced distance at ends of a flat, elongated base, said first and second vertically oriented prongs having a plurality of spaced notches in a face thereof, each of said spaced notches having an angled side and a catch side;

a top piece having a cross member having a pair of openings also positioned at a spaced distance equal to the spaced distance of said first and second vertically oriented prongs, said cross member having an upper surface and a lower surface, said lower surface being in contact with an upper surface of a stack of papers when said stacked paper fastener is affixed through a stack of papers, said cross member having first and second ratchet members on the upper surface thereof, each ratchet member having a passageway for insertion of a one of said first and second vertically oriented prongs therethrough, said passageway having a bottom, two sides and a top thereby forming a closed ratchet passageway, said closed ratchet passageway including a pawl which rides over the angled sides of said spaced notches as the prong is tightened through said ratchet member but said pawl being shaped so that it catches against said catch side of each spaced notch if one attempts to remove said prong from said ratchet member and said pawl also having release means for raising said pawl above said catch side to permit the release of a prong from said ratchet member whereby a stack of papers having a pair of spaced holes adjacent the a side of each sheet of said stack may be fastened by passing the first and second vertically oriented prongs through the pair of spaced holes, placing the top piece over the prongs so that the prongs pass through the pair of openings in the top piece, passing the first and second vertically oriented prongs through the ratchet passageways of the first and second ratchet members and pulling the prongs tight so that the stack of papers is securely fastened together but said stack of papers may be released by operating the release means whereby the prongs may be released by the ratchet members and removed from the top piece and from the stack of papers.

2. The stacked papers fastener of claim 1 wherein the prong unit is fabricated from a polymer.

3. The stacked papers fastener of claim 1 wherein the top piece is entirely fabricated from a polymer.

4. The stacked papers fastener of claim 1 wherein said release means comprises a pawl which is supported in a biased position over said top of said closed passageway and said pawl further has a handle which extends beyond said closed passageway so that it may be raised by a user to lift the pawl out of contact with said catch side of said notches.

5. A stacked paper fastener of the type having a pair of spaced prongs which may be passed through a pair of holes and affixed to a top piece comprising:

a prong unit fabricated from a polymer having a first and second vertically oriented prongs held in a spaced relationship at a spaced distance at ends of a flat, elongated base, said first and second vertically oriented prongs having a plurality of spaced notches in an outer face thereof, each of said spaced notches having an angled side and a catch side;

a top piece fabricated from a polymer having a cross member having a pair of openings also positioned at a spaced distance equal to the spaced distance of said first and second vertically oriented prongs, said cross member having an upper surface and a lower surface, said lower surface being in contact with an upper surface of a stack of papers when said stacked paper fastener is affixed through a stack of papers, said cross member having first and second ratchet members on the upper surface thereof, each ratchet member having a passageway for insertion of a one of said first and second vertically oriented prongs therethrough, said passageway having a bottom, two sides and a top thereby forming a closed ratchet passageway, said closed ratchet passageway including a pawl which rides over the angled sides of said spaced notches as the prong is tightened through said ratchet member but said pawl being shaped so that it catches against said catch side of each spaced notch if one attempts to remove said prong from said ratchet member and said pawl also having an arm which extends beyond an inner surface of said ratchet passageway so that a user may raise said pawl above said catch side to permit the release of a prong from said ratchet member whereby a stack of papers having a pair of spaced holes adjacent an edge of each sheet of said stack may be fastened by passing the first and second vertically oriented prongs through the pair of spaced holes, placing the top piece over the prongs so that the prongs pass through the pair of openings in the top piece, passing the first and second vertically oriented prongs through the ratchet passageways of the first and second ratchet members and pulling the prongs tight so that the stack of papers is securely fastened together but said stack of papers may be released by operating the release means whereby the prongs may be released by the ratchet members and removed from the top piece and from the stack of papers.

* * * * *